US007331707B2

(12) United States Patent
DelValle et al.

(10) Patent No.: US 7,331,707 B2
(45) Date of Patent: Feb. 19, 2008

(54) EVENT MONITORING BRACELET

(76) Inventors: Catherine J. DelValle, 2665 Club Mesa Pl., Costa Mesa, CA (US) 92627; Brian DelValle, 2665 Club Mesa Pl., Costa Mesa, CA (US) 92627

( * ) Notice: Subject to any disclaimer, the term of this patent is extended or adjusted under 35 U.S.C. 154(b) by 172 days.

(21) Appl. No.: 11/002,782

(22) Filed: Dec. 2, 2004

(65) Prior Publication Data

US 2006/0118033 A1 Jun. 8, 2006

(51) Int. Cl.
*G04B 37/00* (2006.01)
*G09F 9/00* (2006.01)

(52) U.S. Cl. ..... 368/282; 368/327; 368/223; 116/321; 116/308

(58) Field of Classification Search ..... 368/224–225, 368/22, 25, 40, 220–222, 281–282, 327; 235/103–104; 116/284, 281, 308, 222, 223, 116/224, 321, 285; D11/4; 434/304
See application file for complete search history.

(56) References Cited

U.S. PATENT DOCUMENTS 1,755,995 A * 4/1930 Lamb ..... 235/122
2,952,967 A * 9/1960 Nussle ..... 368/281
4,130,987 A * 12/1978 Schickedanz ..... 368/29
4,423,734 A 1/1984 Schawel
4,912,307 A * 3/1990 Shade et al. ..... 235/123
5,092,812 A 3/1992 Babcock
5,094,647 A 3/1992 Courtney
D351,492 S 10/1994 Nieslanik
D415,976 S * 11/1999 Be ..... D11/4
6,216,490 B1 * 4/2001 Radley-Smith ..... 63/3
6,264,529 B1 7/2001 Logue
6,880,364 B1 * 4/2005 Vidolin et al. ..... 63/40
D505,353 S * 5/2005 Del Valle ..... D11/3
2002/0172927 A1 * 11/2002 Faulkner ..... 434/202
2003/0089128 A1 * 5/2003 Minassian ..... 63/4
2005/0166636 A1 * 8/2005 Lazor ..... 63/38

* cited by examiner

*Primary Examiner*—Vit Miska
*Assistant Examiner*—Sean Kayes
(74) *Attorney, Agent, or Firm*—Stetina Brunda Garred & Brucker

(57) ABSTRACT

Provided is a bracelet comprising a band which is removably attachable to a wrist of a person. The band may have a plurality of first time indices printed about a circumference of the band. The bracelet may further comprise a first time indicator slidable along the band circumference and fixedly positionable to a selected first time indicia to indicate a time of an event.

13 Claims, 4 Drawing Sheets

EVENT MONITORING BRACELET

CROSS-REFERENCE TO RELATED APPLICATIONS

This application claims the benefit of U.S. Design application No. 29/204,084, filed Apr. 23, 2004.

STATEMENT RE: FEDERALLY SPONSORED RESEARCH/DEVELOPMENT

Not Applicable

BACKGROUND OF THE INVENTION

The present invention relates generally to an event monitoring system and more particularly, to a system utilizing a bracelet to remind a user of a prior event time.

A baby's birth is an exciting event for a family. However, the birth also places may different responsibilities on the baby's parents. For example, for parents who choose to breast feed their babies, the mother must follow a strict breast feeding regimen. The breast feeding regimen of the baby includes periodic feeding as well as alternating breasts during each subsequent feeding.

If the mother does not regularly breast feed her baby and does not alternate breasts during each subsequent feeding, then the mother may cease to lactate. To support the breast feeding regimen, the mother must remember (1) the time of last feeding, and, (2) whether the baby was fed from her right breast or her left breast during the last feeding. Unfortunately, the time of feeding and the breast from which the baby was last fed may be forgotten because of other pressing matters.

Accordingly, there is a need in the art for a device configured to remind the mother of the baby's last feeding time as well as remind the mother as to which of right or left breasts the baby was last fed.

BRIEF SUMMARY OF THE INVENTION

In an embodiment of the present invention, a bracelet may be provided. The bracelet may comprise a plurality of links and a plurality of fillers adjacently attached to each other via a system of supports and connectors. The assembly of links, fillers, supports and connectors also allow the bracelet to expand such that the bracelet may be placed on a persons wrist as well as removed therefrom.

The bracelet may comprise a first time indicator and a second time indicator wherein the first time indicator may be slidable along an outer circumference of the assembly of links, filler, supports and connectors (i.e., the band). The first time indicator may also have an aperture through which a first time indicia placed on a visible surface of the link may be viewed. The first time indicia is representative of a one hour increment of a period of twelve (12) or twenty-four (24) hours. The second time indicator may be slidably engagable to a first indicator longitudinal edge and fixedly positionable adjacent second time indicia placed on a visible surface over the first time indicator wherein the first time indicia may represent quarter hour increments of one hour, namely, zero minutes (e.g., ":00"), fifteen minutes (e.g., ":15"), thirty minutes (e.g., ":30"), and forty-five minutes (e.g., ":45").

The bracelet may be utilized to remember the time of an event (e.g., baby's last feeding). For example, if a mother were to breast feed her baby at one o'clock, then the mother may slide the first time indicator such that Roman Numeral "I" is shown through the first time indicator aperture. Also, the mother may slide the second time indicator such that ":00" indicia is associated with the second time indicator. Hence, the mother may be reminded via the bracelet that the baby's last feeding occurred at one o'clock and time the baby's subsequent feeding in accordance therewith. Further, the bracelet may further remind the mother which breast (i.e., right or left breast) the baby was fed from by placing the bracelet on the corresponding right or left wrist of the mother. For example, if the mother breast fed her baby on her right breast at one o'clock, then the mother may slide the first and second time indicators to indicate one o'clock and wear the bracelet on her right wrist. This reminds the mother that the baby was last fed at one o'clock on her right breast and the mother may subsequently feed the baby on her left breast during the baby's subsequent feeding cycle.

In another aspect of the present invention, the bracelet may be utilized to regulate administration of a medication. In particular, if a patient was prescribed a medication which should be taken every six hours, then at the initial administration of the medication, then the patient may move the first and second time indicators to indicate the time at which the initial administration occurred. For example, if the initial administration occurred at one o'clock, then the first and second time indicators may be adjusted appropriately. This reminds the patient that the patient's next administration of the medication should occur at about seven o'clock. If the patient administers the medication at seven fifteen (7:15), then the patient may slide the first time indicator and second time indicator appropriately to indicate a time of seven fifteen (7:15) by sliding the first time indicator such that "VII" is shown through the first time indicator aperture and sliding the second time indicator such that the same is associated with ":15" indicia.

A plurality of bands may be worn on the wrist of the patient to remind the patient of the last administration of one of a plurality of medications. For example, if the patient was prescribed first and second medications to be administered every four and six hours, respectively, then the patient may wear first and second bracelets respectively associated with the first and second medications. The patient may slide the first and second time indicators of each respective first and second bracelets to indicate the time at which the respective medications was last administered.

BRIEF DESCRIPTION OF THE DRAWINGS

An illustrated and presently preferred embodiment of the present invention is shown in the accompanying drawings in which.

DETAILED DESCRIPTION OF THE INVENTION

Figure 1:
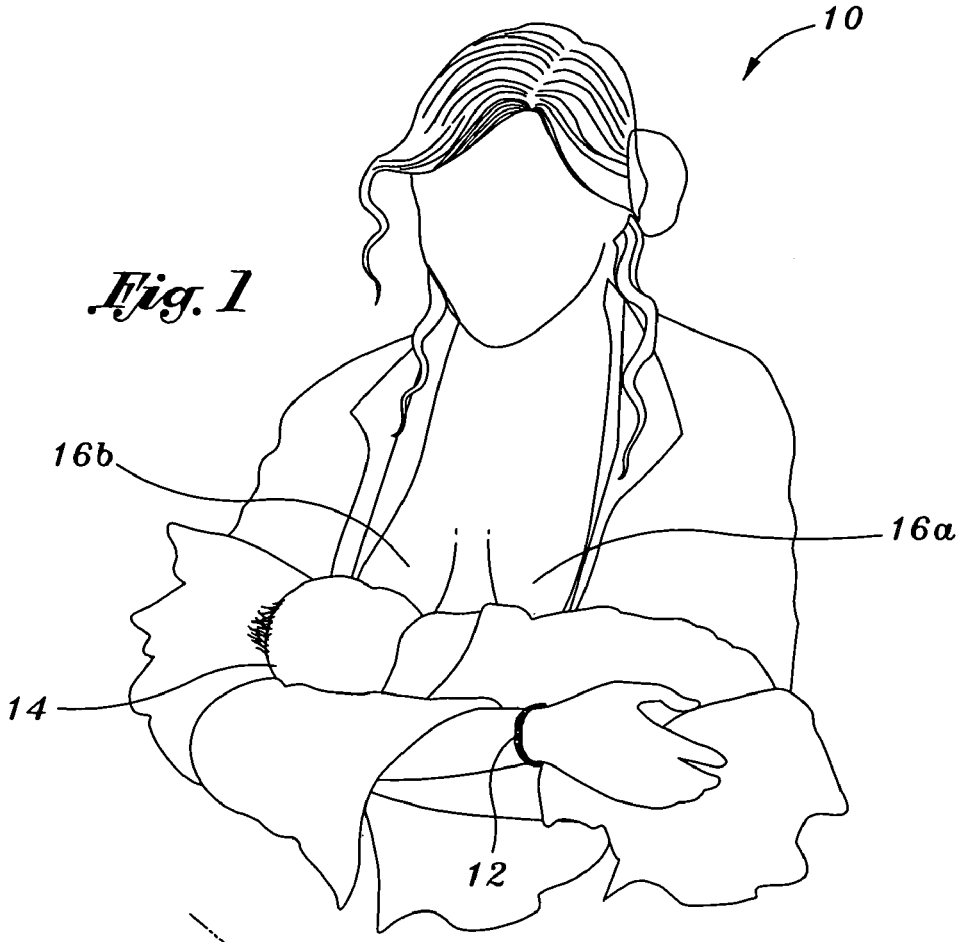
FIG. 1 is a perspective view of a mother breast feeding a baby from her right breast and wearing a bracelet on her right wrist.

The figures referred to herein are for the purpose of illustrating the preferred embodiments of the present invention and not for the purpose of limiting the same. FIG. 1 illustrates a breast feeding mother 10 wearing a bracelet 12 of the present invention. The bracelet allows the mother to remember a baby's 14 last feeding and to remember whether the baby 14 was fed from the mother's left or right breast 16*a, b* during the baby's 14 last feeding. Although the various aspects of the present invention are discussed herein in relation to breast feeding, the bracelet 12 may also be variously embodied and employed in relation to any schedule of events or sequential events.

Figure 2:
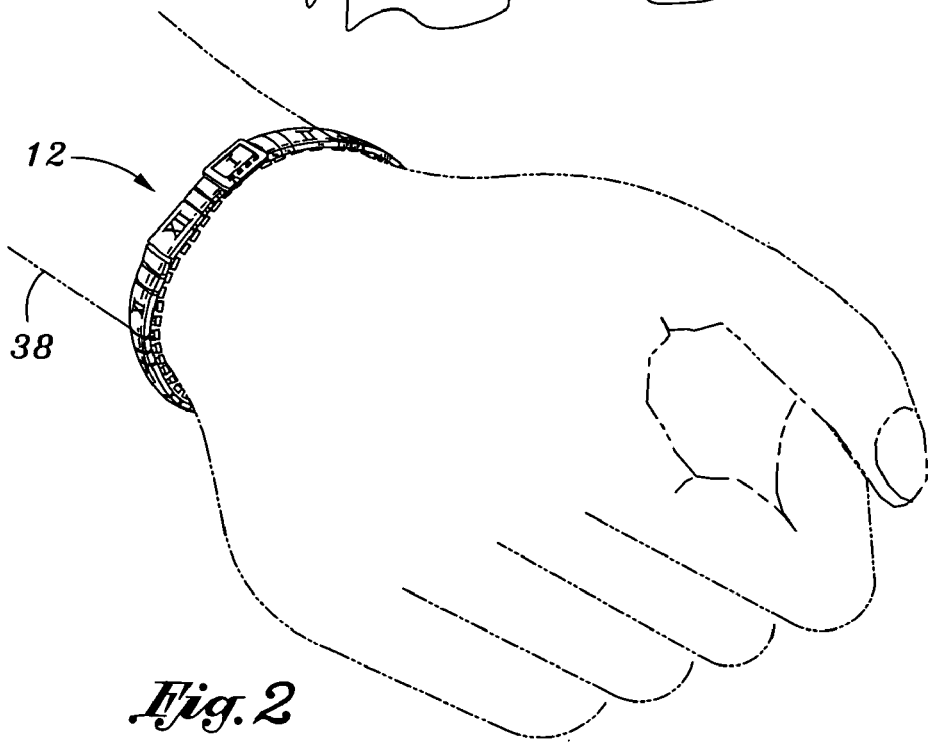
FIG. 2 is a perspective view of the bracelet worn on the right wrist of the mother shown in FIG. 1 wherein the bracelet illustrates a first time indicator slidable along a band and a second time indicator slidable along a first indicator longitudinal edge to indicate a time of an event.
Figure 3:
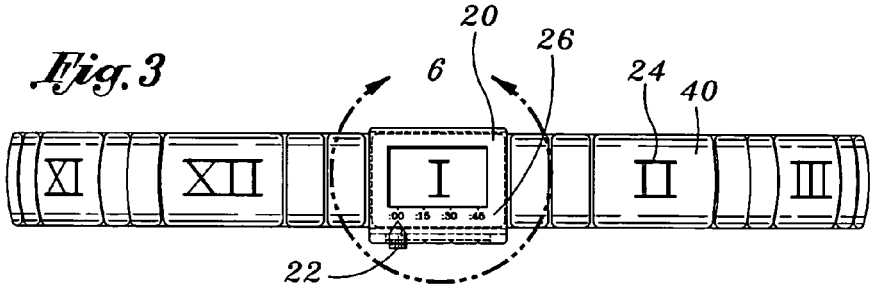
FIG. 3 is a top view of the bracelet.
Figure 5:
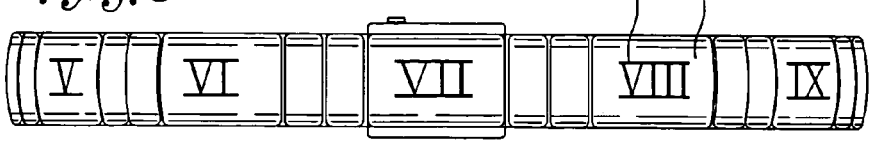
FIG. 5 is a bottom view of the bracelet of FIG. 3.
Figure 6:
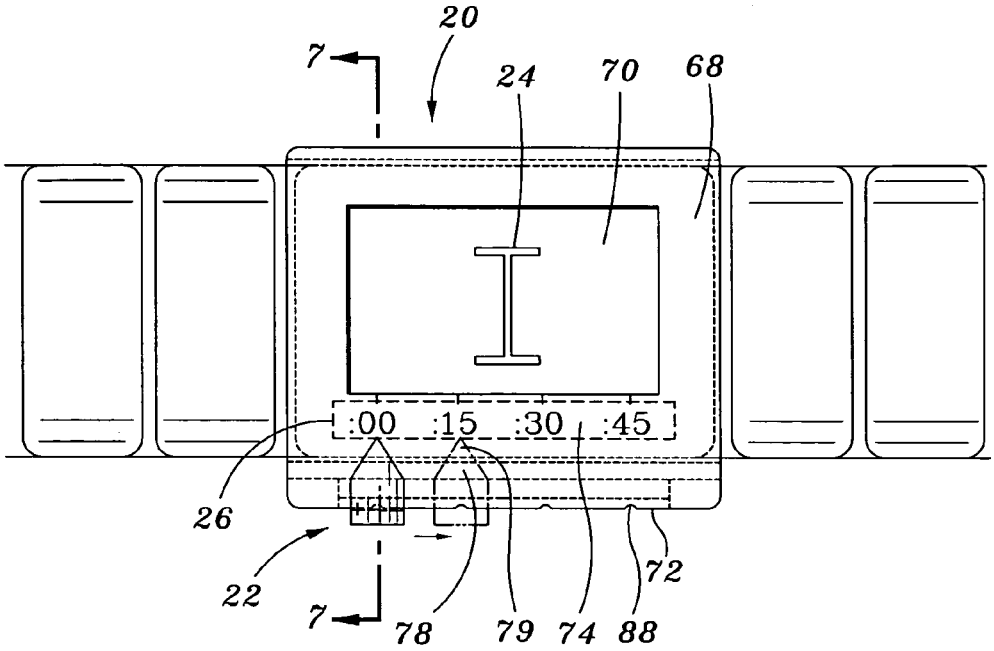
FIG. 6 is a section view of FIG. 3 illustrating the second time indicator slidably engagable to the first indicator longitudinal edge and positionable in four positions.

The bracelet 12 may comprise a band 18 (see FIG. 4), a first time indicator 20 (see FIGS. 3 and 4), a second time indicator 22 (see FIGS. 3 and 4), a plurality of first time indices 24 (see FIGS. 3, 5 and 6; e.g., hourly time indices), and a plurality of second time indices 26 (see FIGS. 3 and 6; e.g., quarter hour time indices). The band 18 may comprise a plurality of links 28 (see FIG. 4) and a plurality of fillers 30*a, b* which are connected end to end so as to form a loop configuration. In particular, each link 28 may be placed adjacently to two (2) fillers 30*a, b* on opposed ends of the link 28 to form a filler-link-filler assembly 32. Further, each filler-link-filler assembly 32 may be placed adjacent to another filler-link-filler assembly 32. There may be a plurality of filler-link-filler assemblies 32 placed next to each other until the loop configuration is formed. Preferably, there may be a total of twelve filler-link-filler assemblies 32 placed adjacent to each other to form the loop configuration. Each link 28 and filler 30 may define a length 34*a, b* which may be sized such that an inner circumference 36 of the band 18 may fit around a person's wrist 38 (see FIG. 2; i.e., left wrist or right wrist).

Figure 4:
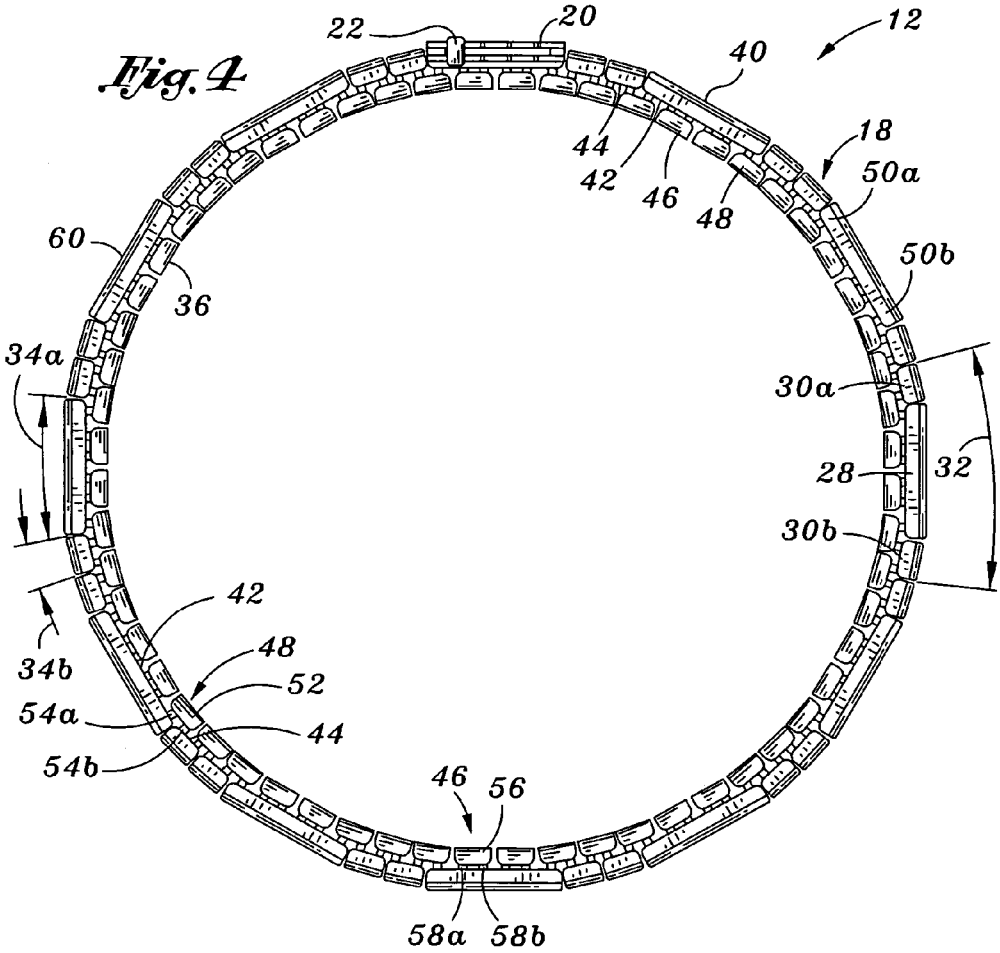
FIG. 4 is a front view of the bracelet of FIG. 3.

Each link 28 may further define an exterior or visible surface 40 (see FIGS. 3-5) on which the first time indices 24 may be indicated. The first time indices 24 may represent each hour of a day, namely, one o'clock to twelve o'clock or one hundred hours to twenty four hundred hours (i.e., military time). As shown in FIGS. 3-5, the band may comprise twelve (12) links 28 with each adjacent link 25 representing one o'clock through twelve o'clock. The first time indicia 24 may be indicated on the visible surface 40 of each link 28 via screen printing, etching, or other methods. Although the first time indicia 24 is shown as Roman Numerals I-XII, the first time indices 24 may also be represented by Arabic numerals or other numeric systems.

The links 28 and fillers 30 may also each define an inner or lower surface 42, 44, respectively, as shown in FIG. 4. The link lower surface 42 may further have attached thereto at least one support 46, and preferably, two supports. One connector 48 may be attached to each distal end 50*a, b* of the link 28 and each connector 48 may also be attached to respective adjacent filler 30. This may form the filler-link-filler assembly 32. Each adjacent filler 30 may also have attached to its inner surface 44 a connector 48 or support 46 which may also attached to an adjacent filler-link-filler assembly 32. This connection of assemblies 32 may be continued with each adjacent filler-link-filler assembly 32 to ultimately form the loop configured band 18.

The connector 48 may have a base 52 and at least two legs 54*a, b*, as shown in FIG. 4. The legs 54*a, b* may independently or in cooperation with each other be pivotable about the base 52. Furthermore, the legs 54*a, b* may pivotally be connected to respective inner surfaces 44, 42 of the filler 30 and/or link 28. The support 46 may also include a base 56 and two legs 58*a, b*. However, in contrast to the connector 48, the support legs 58*a, b* may be stationary in relation to the support base 56 as well as to the inner surfaces 44, 42 of the respective filler 30 or link 28. As such, the links 28, fillers 30, connectors 48, and supports 46 may form the band 18 which may be stretched to place the band around the mother's 10 wrist 38 or to remove the same from the mother's 10 wrist 38.

Figure 7:
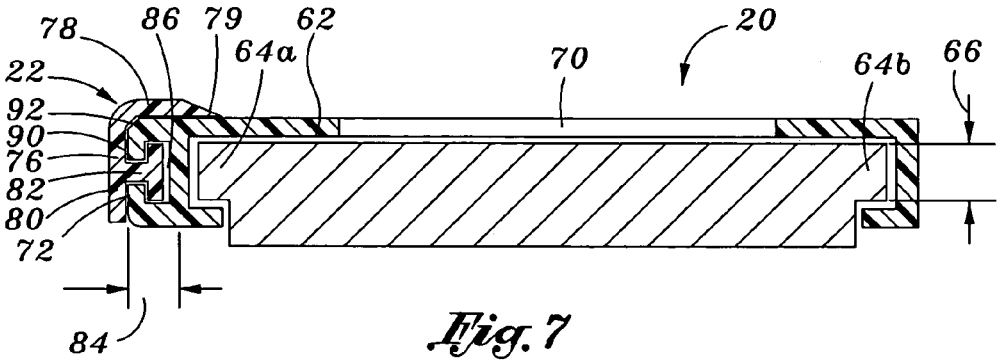
FIG. 7 is a cross-sectional view of a link, first time indicator and second time indicator illustrating the slidable engagement between the link and first time indicator and the first time indicator and second time indicator.

The first time indicator 20 may be slidably engaged to the band 18. In particular, the first time indicator 20 may slide about the outer circumference 60 (see FIG. 4) of the band 18. The structure which enables the first time indicator 20 to slide along the outer circumference 60 of the band 18 may be a C-shape surface 62 (see FIG. 7) which engages about double flared lips 64*a, b* (see FIG. 7) of the links 28 and fillers 30. The double flared lips 64*a, b* may be formed on exterior portions 66 of the links 28 and the fillers 30. Although the exterior portion 66 is shown to engage the C-shaped inner surface 62 with a loose fit, the C-shaped inner surface 62 and the exterior portion 66 may be sized and configured so as to have a friction fit therebetween. As such, the first time indicator 20 may slide along the entire outer circumference 60 of the band 18. Moreover, the friction fit between the first time indicator 20 and the band 18 may also allow the first time indicator 20 to be fixably positionable onto a selected link 28.

The first time indicator 20 may also define a body portion 68 (see FIG. 6). The body portion 68 may have an aperture 70 (see FIGS. 6 and 7) therethrough for viewing the first time indicia 24 of the selected link 28. The aperture 70 may have a square or rectangular configuration but it is also contemplated within the scope of the present invention that the aperture 70 may have a circular, oval or other configuration.

The second time indicator 22 may engage the first time indicator 20. In particular, the first time indicator 20 may define a longitudinal edge 72. The second time indicator 22 may be slidably engagable to such longitudinal edge 72 (see FIG. 6). The second time indicator 22 may be fixably positionable along the first indicator longitudinal edge 72 in four positions, namely, zero minutes, fifteen minutes, thirty minutes, and forty-five minutes, as shown in FIG. 6. In particular, the first time indicator 20 may have on its exterior or visible surface 74 (see FIGS. 6 and 7) second time indices 26 representative of zero minutes, fifteen minutes, thirty minutes, and forty-five minutes. As shown in FIG. 6, the second time indicia may be represented by :00, :15, :30, and :45, respectively. The four positions of the second time indicator 22 may be associated with each second time indicia 26 (e.g., quarter hours). The second time indicator 22 may have an L-shaped body 76 wherein an upper leg 78 of the body 76 may have a pointed tip 79 (see FIGS. 6 and 7). A lower leg 80 of the body 76 may be adjacent to the first indicator longitudinal edge 72 and have attached thereto a T-shaped prong 82. The first time indicator 20 may define a longitudinal edge portion 84. The longitudinal edge portion 84 may have formed therein a corresponding T-shaped slot 86 for receiving the T-shaped prong 82 of the second time indicator 22. The T-shaped prong 82 and the T-shaped slot 86 may have a loose or friction fit therebetween.

The second time indicator 22 may be fixedly positionable in the four positions via four notches 88 (see FIG. 6) formed along the first indicator longitudinal edge 72, as shown in FIG. 6. An inner surface 90 of the L-shaped body 76 may have a nub 92 (see FIG. 7) sized and configured to the notch 88. Accordingly, the second time indicator 22 may be slid along the first indicator longitudinal edge 72 until the nub 92 is received into one of the four notches 88. The second time indicator 22 may also be slid to a different position until the nub 92 is received into a corresponding notch 88. Accordingly, the bracelet 12 allows a person 10 to wear and remove the bracelet 12 from their wrist 38 as well as slide the first time indicator 20 along the band 18 to a selected link 28 so as to view its corresponding first time indicia 24. Further, the second time indicator 22 may be slid along the first indicator longitudinal edge 72 so as to point to one of the second time indices 26.

The bracelet 12 of the present invention may be used to monitor the time of an event's occurrence. For example, as shown in FIG. 1, the event may be breast feeding the baby 14. Since the baby's next or subsequent feeding is based on the time of the baby's last feeding, the bracelet 12 may be used to remind the mother 10 of the baby's last feeding time. In particular, if the baby 14 was fed at one o'clock, the mother 10 may slide the first time indicator 20 along the band 18 such that Roman Numeral "I" is shown through the first time indicator aperture 70. The mother 10 may also slide the second time indicator 22 along the first indicator longitudinal edge 72 until the pointed tip 79 is aligned to ":00." This provides a means to remind the mother 10 when the baby 14 was last fed.

Moreover, the bracelet 12 may be used to remind the mother 10 whether the baby 14 was fed from the left or right breast 16*a, b* during the baby's last feeding. For example, as shown in FIG. 1, the baby 14 may be fed from the mother's right breast 16*b* and the bracelet 12 may then be worn on the mother's right wrist 38. As such, three hours later when the baby 14 is ready for its next feeding, the mother 10 may be reminded that the baby 14 was fed from the mother's right breast 16*b* because the bracelet 12 is currently being worn on the mother's right wrist 38. At this point, the mother 10 may remove the bracelet 12 from her right wrist 38, place the bracelet 12 on her left wrist 38, slid the first and second time indicators 20, 22 along the band 18 and first indicator longitudinal edge 72, respectively, as appropriate. Thereafter, the baby 14 may be breast fed from the mother's left breast 16*a*. The bracelet 12 may be worn in an alternating fashion between the left wrist 38 and right wrist 38 throughout the breast feeding cycles of the baby 14. Further, during each cycle the first and second time indicators 20, 22 may be adjusted accordingly.

In another aspect of the present invention, the bracelet 12 may be utilized to help patients regulate their medication. For example, if a patient was prescribed a medication which should be taken every six hours, then the patient may set the appropriate time on the bracelet when the medication was initially administered. For example, the first time indicator 20 may be slid along the band 18 until the Roman Numeral "II" is shown through the first time indicator aperture 70 if the first administration of the medication occurredd at two o'clock. The patient may subsequently administer the medication at around eight o'clock. If the second administration of the medication occurs at eight fifteen, then the patient may slide the first time indicator 20 to the link 28 with Roman Numeral "VIII" on its visible surface 40 and slid the second time indicator 22 along the first indicator longitudinal edge 72 until the pointed tip 79 is adjacent ":45" indicia 26. During each subsequent administration of the medication, the patient may slide the first and second time indicators 20, 22 according to the time of the subsequent administration.

Figure 8:
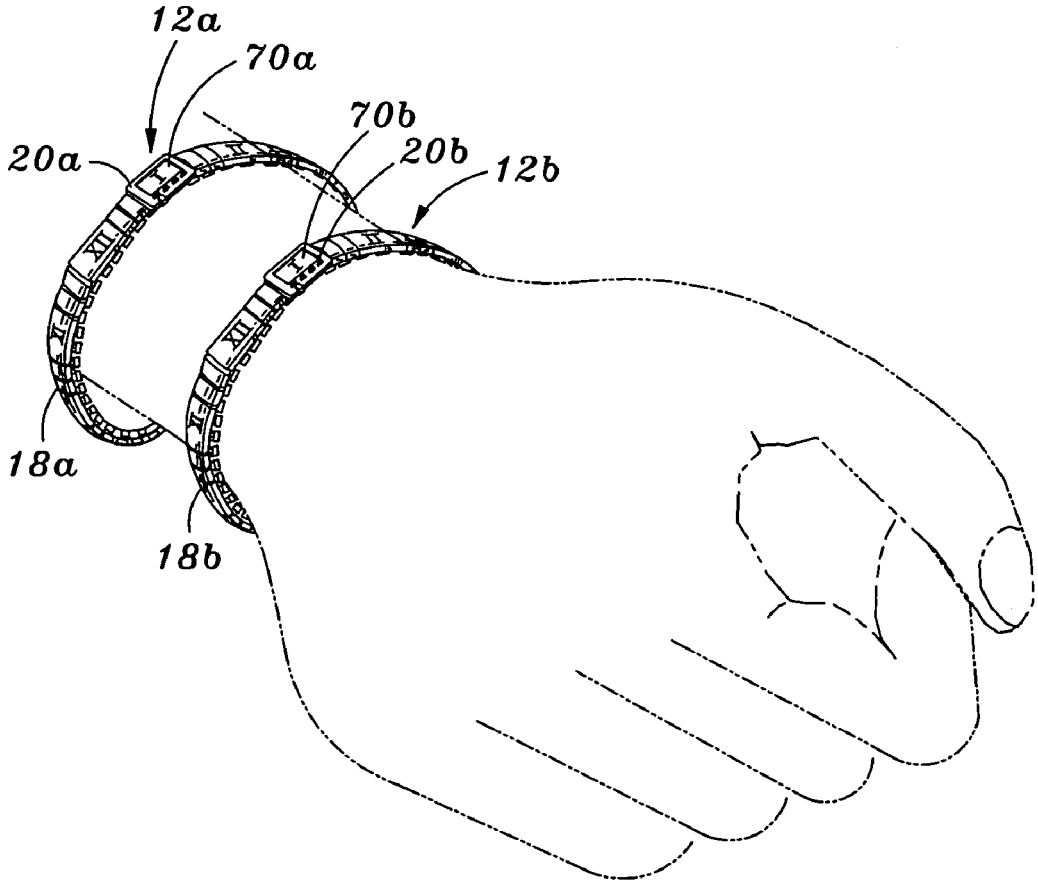
FIG. 8 is a perspective view of a patient wearing a first bracelet and a second bracelet to regulate administration of a first medication and a second medication.

In another aspect of the present invention, the bracelet 12 may be utilized to help patients simultaneously regulate two or more medications. For example, if the patient was prescribed a first medication and a second medication which should be taken every four and six hours, respectively, then the patient may wear a first bracelet 12*a* and a second bracelet 12*b*, as shown in FIG. 8. The first and second bracelets 12*a, b* may be attached to each other. Alternatively, as shown in FIG. 8, the first and second bracelets 12*a, b* may be independent of each other. These bracelets 12*a, b* may have identifying indicia (e.g., color of bracelet 12) associated with respective first and second medications. For example, the first medication may be associated with a blue colored bracelet 12*a* (i.e., the first bracelet 12*a*) and the second medication may be associated with a green colored bracelet 12*b* (i.e., the second bracelet).

In use, the patient may initially administer both the first and second medications at one o'clock. The patient may slide the first time indicators 20*a, b* of both bracelets 12*a, b* along the bands 18*a, b* until Roman Number "I" is shown through the apertures 70*a, b*. At five o'clock which is the time for the next administration of the first medication, the patient may administer the first medication and slide the first time indicator 20*a* of the blue colored bracelet 12*a* until Roman Numeral "V" is shown through respective first time indicator aperture 70*a*. At seven o'clock which is the time for the next administration of the second medication, the patient may administer the second medication and slide the first time indicator 20*b* of bracelet 12*b* until Roman Numeral "VII" is shown through respective first time indicator aperture 70*b*. At each subsequent administration of the first and second medications, the patient may slide the first and second time indicators 20*a*, 20*b*, 22*a*, 22*b* accordingly to remind the patient when the last administration of the first and second medications occurred.

This description of the various embodiments of the present invention is presented to illustrate the preferred embodiments of the present invention, and other inventive concepts may be otherwise variously embodied and employed. The appended claims are intended to be construed to include such variations except in so far as limited by the prior art.

What is claimed is:

1. A bracelet for monitoring an event comprising:

an encircling band removably attachable to a wrist of a person, the band having a plurality of first time indices indicated about a circumference of the band;

a first time indicator manually slideable along the band circumference and positionable to a selected first time indicia to monitor the time of the event, the first time indicator remaining at the selected first time indicia until the first time indicator is manually re-slid and repositioned to a different first time indicia to monitor the time of a subsequent event;

a plurality of second time indices indicated on the first time indicator; and a second time indicator slideable along an edge of the first time indicator and fixably positionable to a selected second time indicia.

2. The bracelet of claim 1 wherein the second time indicator has a T-shaped protrusion and the first time indicator has a corresponding T-shaped slot wherein the protrusion is slideably engageable along the slot.

3. The bracelet of claim 2 wherein the second time indicator frictionally engages the first time indicator for fixedly positioning the second time indicator adjacent to the selected second time indicia.

4. A bracelet for monitoring an event comprising:

an encircling band having a plurality of links connected end to end, the band being removably attachable to a wrist of a person, the band having a plurality of first time indices indicated about a circumference of the band; and a first time indicator manually slideable along the band circumference and positionable to a selected first time indicia to monitor the time of the event, the first time indicator remaining at the selected first time indicia until the first time indicator is manually re-slid and repositioned to a different first time indicia to monitor the time of a subsequent event.

5. The bracelet of claim 4 wherein the plurality of first time indices represents twelve hours of a day.

6. The bracelet of claim 4 wherein the band is elastic.

7. The bracelet of claim 4 wherein one of the first time indices is indicated on each link.

8. A bracelet for monitoring an event comprising:

an encircling band removably attachable to a wrist of a person, the band having a plurality of first time indices indicated about a circumference of the band; and a first time indicator has a C-shaped surface and an exterior portion of the band engages the C-shaped surface to retain the first time indicator on the band, the first time indicator being manually slideable along the band circumference and positionable to a selected first time indicia to monitor the time of the event, the first time indicator remaining at the selected first time indicia until the first time indicator is manually re-slid and repositioned to a different first time indicia to monitor the time of a subsequent event.

9. The bracelet of claim 8 wherein the C-shaped surface and the exterior portion frictionally engages each other.

10. A method of monitoring an event, the method comprising the steps of:

a. providing a bracelet comprising:

i. an encircling band removably attachable to a wrist of a person, the band having a plurality of first time indices indicated about a circumference of the band; and ii. a first time indicator slideable along the band circumference and positionable to a selected first time indicia to indicate a time of the event.

b. wearing the bracelet;

c. manually positioning the first time indicator to a selected first time indicia based on the time of the event with the first time indicator remaining at the selected first time indicia until an occurrence of a subsequent event; and d. after the occurrence of the subsequent event, manually repositioning the first time indicator to a different first time indicia based on the occurrence of the subsequent event.

11. The method of claim 10 wherein step b comprises wearing the bracelet on a left or right wrist of the person.

12. The method of claim 10 wherein the provided bracelet further comprises iii. a plurality of second time indices indicated on the first time indicator; and iv. a second time indicator slideable along the first time indicator and fixably positionable to a selected second time indicia.

13. The method of claim 10 wherein in step c), the first time indicator is manually positioned to the selected first time indicia associated with the time of the event for recording the time of the event, and wherein in step d), the first time indicator is manually repositioned to the different first time indicia associated with the time of the subsequent event for recording the time of the subsequent event.

* * * * *